US006591425B1

(12) United States Patent
Zellers

(10) Patent No.: US 6,591,425 B1
(45) Date of Patent: Jul. 15, 2003

(54) UNDERGARMENT WITH PERMANENTLY ATTACHED PERSPIRATION COLLECTING SHIELD

(76) Inventor: Mary P. Zellers, 53 Fieldcrest Rd., Arden, NC (US) 28704

( * ) Notice: Subject to any disclaimer, the term of this patent is extended or adjusted under 35 U.S.C. 154(b) by 0 days.

(21) Appl. No.: 10/091,541

(22) Filed: Mar. 7, 2002

(51) Int. Cl.[7] ..... A41B 1/00
(52) U.S. Cl. ..... 2/54; 2/115; 2/78.1
(58) Field of Search ..... 2/113, 115, 69, 2/1, 53, 54, 109, 78.1, 106, 105, 55–58; 450/37

(56) References Cited

U.S. PATENT DOCUMENTS 519,487 A * 5/1894 Warner ..... 2/54
1,477,218 A * 12/1923 Gurzburg ..... 2/53
2,177,543 A * 10/1939 Vecchi ..... 2/113
2,238,466 A * 4/1941 Gardner ..... 2/115
2,309,601 A * 1/1943 Kneibler ..... 2/113
2,750,595 A * 6/1956 Hollinger ..... 2/113
3,013,275 A * 12/1961 Heilbronner ..... 2/113
3,281,863 A * 11/1966 Beard et al. ..... 2/113
3,474,465 A * 10/1969 Artzt ..... 2/113
3,508,279 A * 4/1970 Agoub ..... 2/113
3,588,916 A * 6/1971 Glatt ..... 2/54
5,570,471 A * 11/1996 Krawchuk ..... 2/53
6,347,407 B1 2/2002 Dowell

* cited by examiner

*Primary Examiner*—Gloria Hale

(57) ABSTRACT

An underarm perspiration collecting shield that is part of the construction of an undergarment. The undergarment, designed primarily but not exclusively for men, is comprised of a front and back torso section, sleeves that cover the upper arms, and a neck opening for the head. The perspiration collecting shield is constructed of three layers. The layer closest to the wearer's underarm is constructed of material consistent with that used to make the undergarment. The middle layer is constructed of absorbent material capable of absorbing a minimum of 2 fluid ozs of perspiration before becoming saturated. The middle layer is permanently bonded to a third layer of pliable waterproof material to prevent moisture from leaking through to the wearer's clothing. These three layers, as one item, are sewn into the underarm area of the garment, extending into the front and torso sections.

10 Claims, 3 Drawing Sheets

UNDERGARMENT WITH PERMANENTLY ATTACHED PERSPIRATION COLLECTING SHIELD

FEDERALLY SPONSORED RESEARCH

Not Applicable

SEQUENCE LISTING OR PROGRAM

Not Applicable

BACKGROUND—Field of Invention

Figure 1:
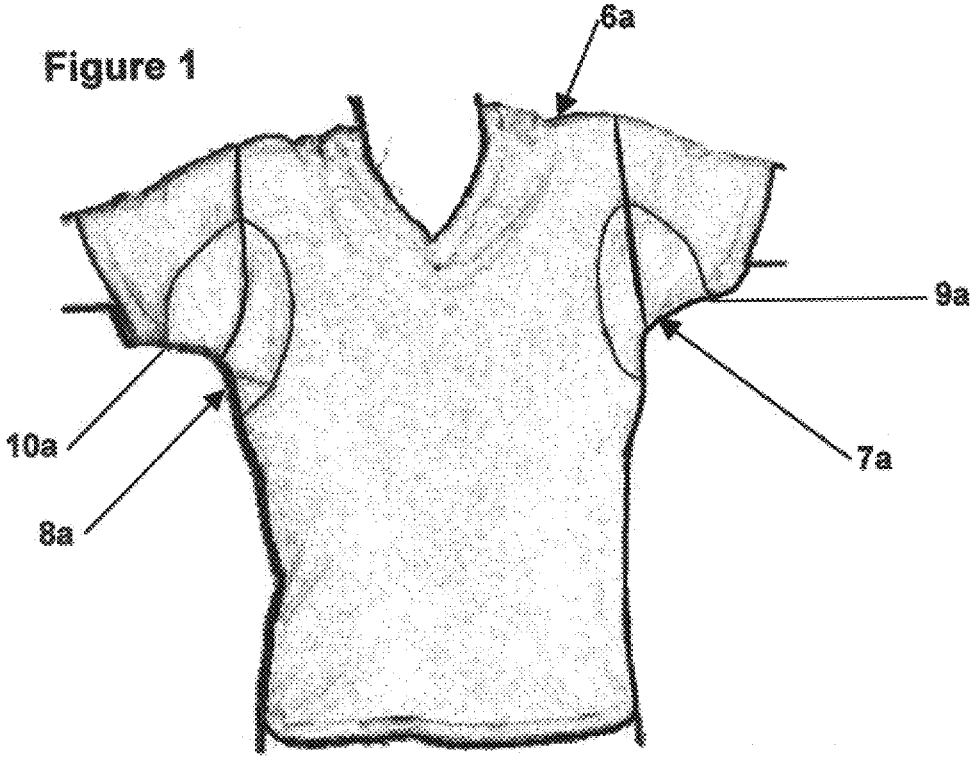

The present invention relates generally to the field of undergarment clothing and more particularly to undergarments that protect outer clothing from underarm perspiration.

BACKGROUND—Discussion of Prior Art

During periods of high activity, anxiety, stress or nervousness, sweating increases, especially under the arms. Also, some people naturally tend to sweat in greater quantities than others. Underarm perspiration causes garments to become soiled during use. In addition to damage to the outer garment, perspiration can soak through to the outer garment and become visible underneath the sleeve area of the garment causing discomfort and embarrassment to the wearer.

Dress shields and other methods have been introduced in an effort to control this problem. Most of these prior inventions are designed for women. As far back as 1908, U.S. Pat. No. 887,454, D. Basch, introduced one such device. In this invention a strap loops about the shoulder portion of the arm, affixing a multi-leafed shield to the underarm area. The strap is centrally located with respect to the leaves, and holds the device in place. The title of the invention "dress shield" implies that it is designed primarily for women.

U.S. Pat. No. 6,138,276, C. Asciutto and L. Pinney, introduces an underarm perspiration shield that attaches to the shoulder strap of a wearer's undergarment. By design this underarm device requires the wearer to have an undergarment with straps. U.S. Pat No. 5,042,089, P. Carmer, is a perspiration shield that has sleeves and is permanently attached to a woman's bra undergarment when it is manufactured. Neither of these dress shield devices would be suitable for the male wearer since males do not typically wear women's bras.

U.S. Pat. No. 6,282,720, J. Mayer, is a lightweight tightly fitted garment for women that include potential for shields in the underarm area. It's very design is to be used for women and is created to be an alternative to the heavier weight larger design of men's undergarments (t-shirts).

Another clothing shield that does attempt to target the male user, U.S. Pat. No. 3,885,247, R. Kost, is affixed, by adhesive means, to the skin of the underarm of the wearer to absorb perspiration. The problem with perspiration shields of this nature is that they may become dislodged or bunch up during wear, causing discomfort and possibly failure to collect perspiration for the wearer.

U.S. Pat. No. 6,145,129, G. Czekalla and J. Czekalla, introduces a device to absorb underarm perspiration that includes a central body with an absorbent pad in the underarm area. The device is designed to attach to the wearer's body with straps secured to the arm and over the shoulder and contains an absorbent pad that may be removable and replaceable once soiled. The problem with this invention is the difficulty and time required to position the device correctly in place as well as adjusting to the presence of the attachment straps.

Thus, while the foregoing body of prior art indicates it to be well known to use shields to absorb sweat in the underarm area of the body, the provision of a mechanically simple, easy to use device, especially for men, is not contemplated. Garment shields of the prior art suffer from the following disadvantages:

a) They are predominantly designed for women.

b) They are not of adequate size to completely cover the perspiration area.

c) They are not designed to collect a sufficient amount of perspiration.

d) They are tedious and time-consuming to position for use.

e) They do not adequately conform to the wearer's garment.

f) They become dislodged during use.

g) They bunch up and cause unsightly shapes that become visible through the outer garment.

The foregoing disadvantages are overcome by the unique simple design of this invention as will be made apparent from the following description thereof.

OBJECTS AND ADVANTAGES

The prior art problems as typified by the prior art cited above, but overcome by the present invention, include:

a) It is designed primarily but not exclusively for men in the form of a t-shirt undergarment.

b) It is sized sufficiently to cover the entire underarm of the undergarment, extending into the front and back torso section.

c) It is constructed of absorbent material capable of containing a minimum of 2 fluid ozs of perspiration.

d) It's use is as simple as slipping an undergarment onto the body.

e) It is manufactured as a part of the garment.

f) It is sewn securely in place, eliminating dislodging or bunching during wear.

Further objects and advantages are that the complete undergarment, including perspiration collecting shield, are made of such material that will allow for laundering in warm water and drying in a clothes dryer. It will not be necessary to carefully fit the perspiration collecting shield in place. There are no disposables to purchase or have available. The undergarment can be worn many times, making it economical and especially when considering that undergarments are generally already a part of the average person's wardrobe. Good fit can be assured by purchasing the regularly preferred size of undergarment.

SUMMARY

In accordance with this present invention an upper body undergarment (primarily but not exclusively for men) comprises front and back torso sections, sleeves that cover the upper arms, and a neck opening for the head. A perspiration collecting shield is permanently sewn at time of manufacture into the underarms of the garment. The shield is comprised of three layers of material. The layer closest to the wearer's underarm is constructed of material consistent with that used to make the undergarment. The middle layer is constructed of absorbent material capable of absorbing a minimum of 2 fluid ozs of perspiration. The middle layer is permanently bonded to a third layer of pliable waterproof material.

DRAWINGS

FIG. 1: Front outside perspective view of the torso and upper arm regions of an undergarment (t-shirt) embodying the perspiration collecting shield.

Figure 2:
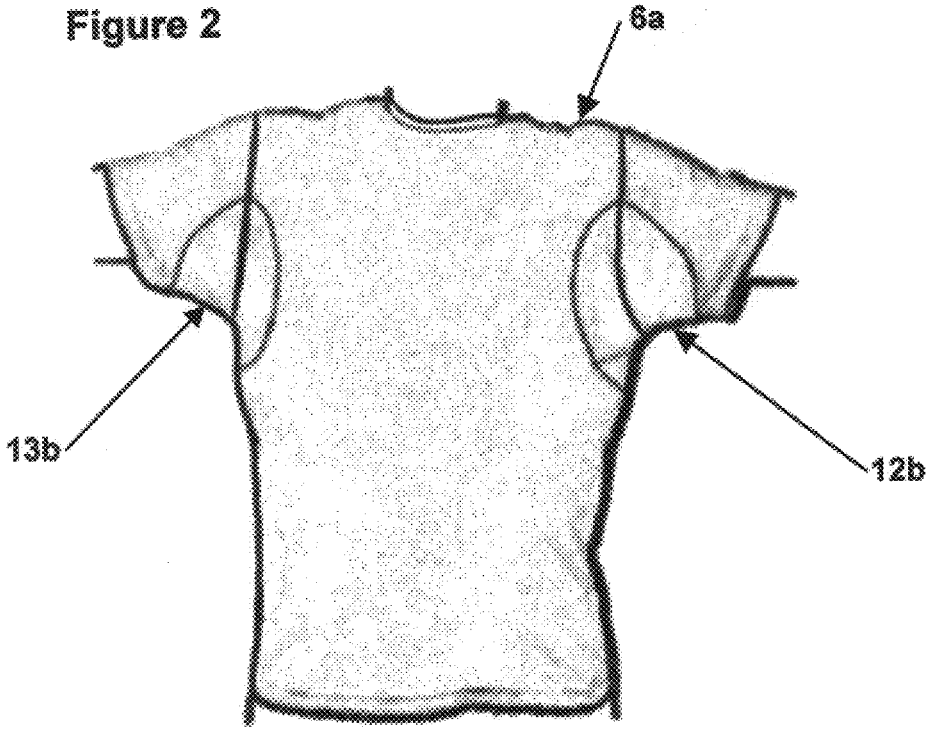

FIG. 2: Back outside perspective view of the torso and upper arm regions of an undergarment (t-shirt) embodying the perspiration collecting shield.

Figure 3:
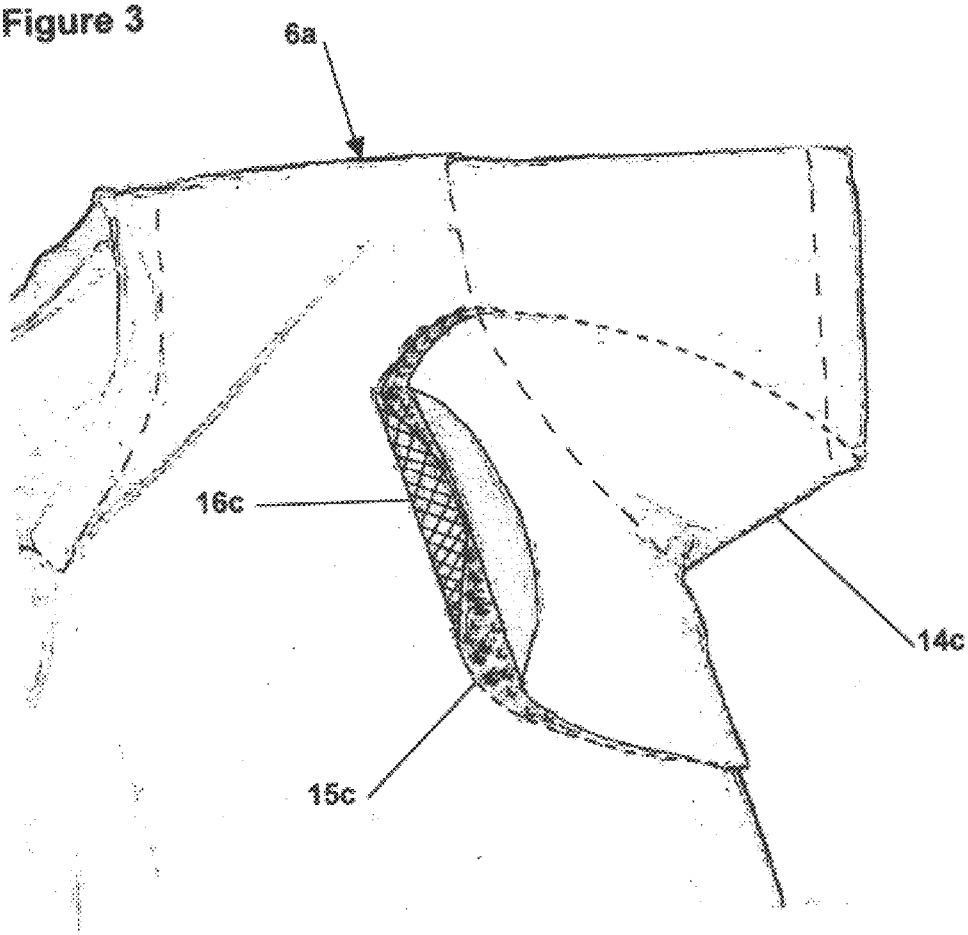

FIG. 3: Partial perspective front view of one inside sleeve of an undergarment (t-shirt), detailing the construction of the perspiration collecting shield.

Figure 4:
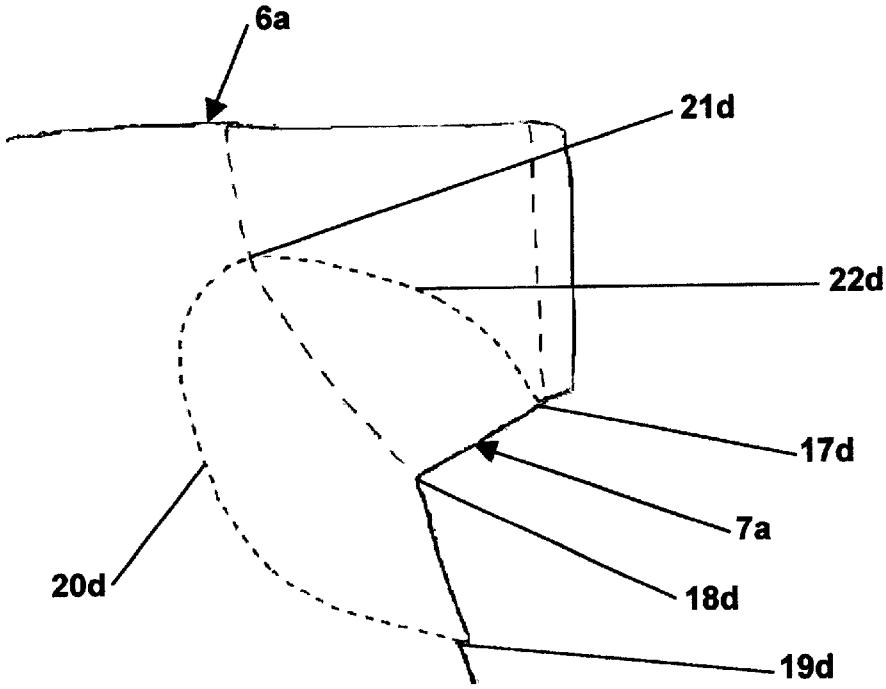

FIG. 4: Partial perspective front view of one outside sleeve of an undergarment (t-shirt), detailing the construction of the perspiration collecting shield.

Figure 5:
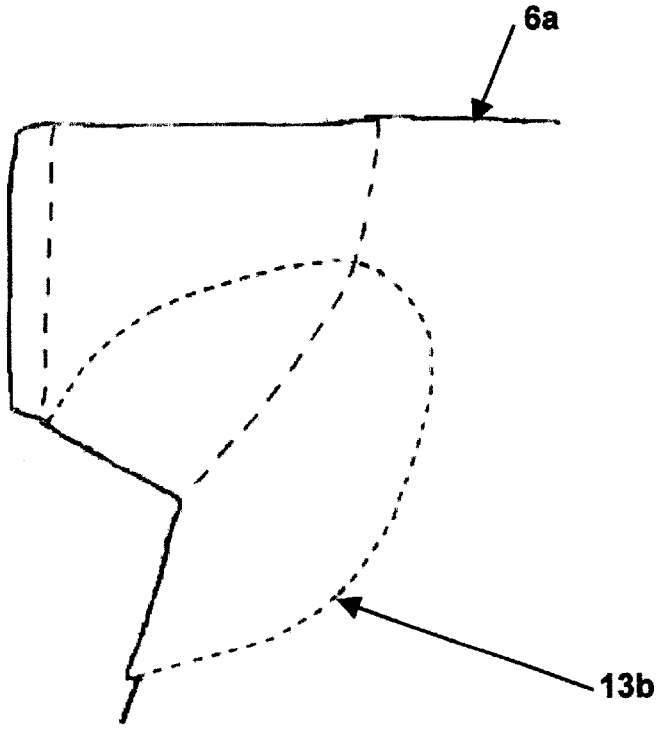

FIG. 5: Partial perspective back view of one outside sleeve of an undergarment (t-shirt), detailing the construction of the perspiration collecting shield.

OPERATIONS—Preferred Embodiment

FIG. 1 illustrates the front view 6*a* of an undergarment (t-shirt) embodying the present invention 7*a*, 8*a*. The undergarment (t-shirt) 6*a* is comprised of front and back torso sections, sleeves that cover the upper arms, and a neck opening for the head. Solid lines 9*a*, 10*a* illustrate the placement of the perspiration collecting shield sewn to the reverse side of the garment when it is manufactured. A clean seam is visible on the front side of the garment 9*a*, 10*a*. FIG. 2 illustrates the back view of the same undergarment (t-shirt) 6a as shown in FIG. 1, detailing that the back half of the perspiration collecting shield 12*b*, 13*b* is identical to the front portion 8*a*, 7*a* and is a continuation of it. The undergarment (t-shirt) 6*a* is constructed of high quality cotton, spandex, polyester or other materials or blends of any of these materials known to be suitable for undergarments (t-shirts).

FIG. 3 illustrates the construction of the perspiration collecting shield. The outermost layer of the shield 14*c* is constructed of identical material as the undergarment (t-shirt) body 6*a*. This layer of the shield is constructed of the same high quality cotton, spandex, polyester or other materials or blends of any of these materials know to be suitable for undergarments (t-shirts). Layer 15*c* is constructed of highly absorbent material capable of absorbing a minimum of 2 fluid ozs of perspiration before becoming saturated. Layer 16*c* is a pliable waterproof material that will contain perspiration within the shield and prevent exposure to the wearer's outer garment. Layer 15*c* is permanently bonded to layer 16*c* to avoid bunching of the perspiration-absorbing shield with wear or washing.

The perspiration collecting shield is permanently sewn into the underarms of the undergarment at time of manufacture. The shape and size of the shield FIG. 4 and FIG. 5, will be sufficient to cover the entire underarm sleeve portion of the undergarment, extending into the front and back torso region. The exact dimensions vary with the size of the undergarment. However, for illustration purposes, the perspiration collecting shield for a man's standard size large undergarment (t-shirt), FIG. 4 and FIG. 5, are as follows: The end to end measurement of the tallest points of the shield 19*d* to 21*d* is approximately 9". The width at its widest point, 20*d* to 22*d*, is approximately 6". The garment sleeve edge attaching seam 17*d* to the garment sleeve to torso attaching seam 18*d* is approximately 3". The bottom of the garment torso attaching seam 19*d* to the garment sleeve to torso attaching seam 18*d* is approximately 4". FIG. 5 illustrates the back view of FIG. 4, detailing that the back half of the perspiration collecting shield 13*b* is identical to the front portion 7*a* and is a continuation of it.

CONCLUSION

There are many types of shields available to prevent perspiration from appearing on a wearer's clothing. This perspiration collecting shield is permanently sewn, at the time it is manufactured, into the underarm area of an upper body undergarment (primarily but not exclusively for men) that is comprised of a front and back torso section, sleeves that cover the upper arms, and a neck opening for the head. Of great importance to distinguish this perspiration collecting shield from other designs is the construction of its layers. The layer closest to the wearer's underarm is constructed of material consistent with that used to make the undergarment. The middle layer is constructed of absorbent material capable of absorbing a minimum of 2 fluid ozs of perspiration before becoming saturated. This middle layer is permanently bonded to a third layer of pliable waterproof material to prevent any moisture from leaking through to the wearer's clothing.

What is claimed is:

1. An undergarment to collect underarm perspiration to prevent outer clothing from becoming soiled during use, which includes a front and back torso section with an opening for pulling the undergarment over the wearer's head; sleeves that cover a wearer's upper arms attached to the undergarment creating an inside and outside underarm area, a neck opening for the head; and a perspiration collecting shield attached directly to the inside underarm area of the garment, comprised of three layers including one layer which comes in direct contact with the wearer's skin constructed of any one of or a combination of cotton, spandex, polyester or other materials identical to the undergarment material; one layer of highly absorbent material capable of containing a minimum of two fluid ounces of perspiration; and one layer of pliable waterproof material attached to the highly absorbent layer wherein the outside underarm area of the undergarment will come in direct contact with the wearer's clothing.

2. An undergarment according to claim 1 in which the front and back torso section, sleeves, and perspiration collecting shield are sewn together to become one item when they are manufactured.

3. An undergarment according to claim 1 in which the front and back torso section, sleeves, and first layer of said perspiration collecting shield are constructed of high quality cotton, spandex, polyester or other materials or blends of such materials suitable for undergarments.

4. An undergarment according to claim 1 in which the neck opening is circular or in the shape of a V.

5. An undergarment according to claim 1 in which the neck opening contains a hem to prevent it from losing its shape with laundering or wear.

6. An undergarment according to claim 1 in which the bottom torso opening contains a hem to prevent it from losing its shape with laundering or wear.

7. An undergarment according to claim 1 in which said sleeves cover approximately one half the distance of the wearer's upper arm.

8. An undergarment according to claim 1 in which said sleeves contain a hem to prevent them from losing their shape with laundering or wear.

9. An undergarment according to claim 1 in which the three layers of the perspiration collecting shield are sewn together to become one item before being attached to the undergarment.

10. An undergarment according to claim 1 in which said perspiration collecting shield covers the entire underarm portion of the garment, extending into the front and back torso sections of the garment.

* * * * *